US006745779B2

(12) United States Patent
Piatetsky

(10) Patent No.: US 6,745,779 B2
(45) **Date of Patent: *Jun. 8, 2004**

(54) TREATMENT HAIRBRUSH

(76) Inventor: Andrey Piatetsky, 5702 Rhea Ave., Tarzana, CA (US) 91356

( * ) Notice: Subject to any disclaimer, the term of this patent is extended or adjusted under 35 U.S.C. 154(b) by 0 days.

This patent is subject to a terminal disclaimer.

(21) Appl. No.: 10/345,577

(22) Filed: Jan. 16, 2003

(65) Prior Publication Data

US 2003/0102003 A1 Jun. 5, 2003

Related U.S. Application Data

(63) Continuation-in-part of application No. 09/589,932, filed on Jun. 7, 2000, now Pat. No. 6,530,378, which is a continuation-in-part of application No. 09/510,210, filed on Feb. 22, 2000, now Pat. No. 6,158,442.

(51) Int. Cl.[7] ..... A45D 24/22

(52) U.S. Cl. ..... 132/115

(58) Field of Search ..... 132/108, 109, 132/110, 111, 112, 113, 114, 115, 120, 147, 148; 401/268, 274, 282, 283, 286, 287; 15/205.2

(56) References Cited

U.S. PATENT DOCUMENTS

| | | | | | |
|---|---|---|---|---|---|
| 940,196 | A | * | 11/1909 | Sartell | 132/115 |
| 1,263,693 | A | * | 4/1918 | Mathews | 132/114 |
| 1,462,400 | A | * | 7/1923 | Warren | 15/397 |
| 1,664,168 | A | * | 3/1928 | Harris | 132/115 |
| 2,101,132 | A | * | 12/1937 | Daly et al. | 132/219 |
| 2,259,931 | A | * | 10/1941 | Griffith | 132/113 |
| 2,519,740 | A | * | 8/1950 | Call | 132/115 |
| 2,546,541 | A | * | 3/1951 | Hunt | 132/124 |
| 3,101,086 | A | * | 8/1963 | Di Vito | 132/114 |
| 3,119,142 | A | * | 1/1964 | Fletcher | 401/273 |
| 3,203,025 | A | * | 8/1965 | Schreur | 401/284 |
| 3,721,250 | A | * | 3/1973 | Walter et al. | 132/112 |
| 3,964,501 | A | * | 6/1976 | Matchett | 132/112 |
| 4,055,195 | A | * | 10/1977 | Moses | 132/115 |
| 4,585,018 | A | * | 4/1986 | O'Connor | 132/120 |
| 4,688,959 | A | * | 8/1987 | Snedeker et al. | 401/283 |
| 4,867,183 | A | * | 9/1989 | Busch et al. | 132/110 |
| 4,913,172 | A | * | 4/1990 | Chou | 132/118 |
| 5,154,193 | A | * | 10/1992 | Busch et al. | 132/110 |
| 5,927,290 | A | * | 7/1999 | Thiruppathi | 132/116 |
| 5,964,226 | A | * | 10/1999 | Sobel | 132/108 |
| 6,158,442 | A | * | 12/2000 | Piatetsky | 132/115 |
| 6,276,367 | B1 | * | 8/2001 | Piatetsky | 132/115 |

* cited by examiner

*Primary Examiner*—Eduardo C. Robert

(57) ABSTRACT

A treatment hairbrush that is capable of evenly dispersing water-based solutions and other thin and non-viscous liquids over the user's scalp during routine hair brushing. An absorbent filler unit is placed into a chamber of the hairbrush body and absorbent feed rods are mounted into bores inside the hairbrush bristles. The absorbent feed rods interconnect the absorbent filler unit and roller-ball nozzles located at the bristle's ends. Liquid disperses over the user's scalp only during rolling contact of the roller-balls mounted within the nozzles with the scalp. The hairbrush can be provided with a removable handle and with a filler inlet located at a junction between the hairbrush body and the handle. The user can refill the hairbrush with or without a disposable liquid refilling cartridge, which holds a predetermined volume of liquid. The hairbrush comes with a removable bristle lid to help prevent the roller-ball nozzles from drying out.

8 Claims, 11 Drawing Sheets

TREATMENT HAIRBRUSH

CROSS-REFERENCE TO RELATED APPLICATIONS

This is a continuation-in-part of U.S. patent application Ser. No. 09/589,932, filed on Jun. 7, 2000, now U.S. Pat. No. 6,530,378, which is a continuation-in-part of U.S. patent application Ser. No. 09/510,210, filed on Feb. 22, 2000, now U.S. Pat. No. 6,158,442.

BACKGROUND OF THE INVENTION

Liquid-reservoir hairbrushes and combs have been available for years. In addition to combing and brushing, these devices allow a user to distribute water and oil-based solutions over the user's scalp and/or hair. In some of these devices, liquid outlets (viz., nozzles) are mounted at distal ends of teeth or bristles. In other devices, the nozzles are located near proximal ends of teeth or bristles (usually between them) or at a body of the hair device. However, these prior art devices have a variety of shortcomings.

For example, if the user wants to disperse liquid only over the scalp, and the nozzles are located at a bristle area of the body of the hairbrush (e.g. U.S. Pat. No. 5,927,290 to Thiruppathi) or between the comb teeth (e.g. U.S. Pat. No. 3,964,501 to Matchett), liquid dispensed from the nozzle initially deposits on the user's hair, wets the hair, and only thereafter contacts the user's scalp. This can makes the user's hair excessively wet and uncomfortable.

Moreover, because the diameter of the nozzle is much smaller than the size of a liquid reservoir, different types of pumps are used to force liquid to flow through nozzles. Accordingly, a person using this type of device has to adjust the liquid flow dispensed through the nozzle by operating different types of control mechanisms (e.g. U.S. Pat. No. 3,721,250 to Walter and U.S. Pat. No. 5,927,290 to Thiruppathi). Since the user usually has to perform the above procedure during hair brushing or combing, the prior art liquid-reservoir hairbrushes and combs with pumps are relatively complicated to operate.

Furthermore, there are other problems associated with the dispersion of water-based solutions and other thin and non-viscous liquids over the user's scalp for devices with pumps. If the nozzles are mounted within the ends of the hairbrush bristles or comb teeth (e.g. U.S. Pat. No. 3,101,086 to Di Vito), it would appear to be troublesome to control the liquid flow through the nozzles. Since most of the above devices have open-end teeth or bristles, liquid will come out from the nozzles whether or not there is contact with the user's scalp. Because all hairbrush bristles and comb teeth cannot entirely contact the user's scalp simultaneously, the excessive liquid disperses between the user's hairs and makes them wet or moist. Others have attempted to devise ways to work around this problem. For example, U.S. Pat. No. 4,055,195 to Moses discloses a fluid-reservoir hair comb with roller-balls mounted within the end of each comb tooth. Although the roller-ball installed within the nozzle can partially control a high viscosity liquid flow of the oil-based solutions dispensed from the particular nozzle, the Moses construction is absolutely not acceptable for low viscosity water-based solutions and other thin and non-viscous liquids. A well-known effect (previously described for ball point pens) of the natural outflow of liquid through a gap between the roller-ball and an internal wall of the roller-ball seat, a so-called direct-flow phenomenon, in which air flows in through the gap to allow liquid to flow out from the liquid reservoir, is liable to take place. Even more, there are another two potential problems for the users of the Moses device. First, the Moses reference notes that the roller-ball installed within the nozzle of the comb tooth can release liquid only upon moving contact of the roller-ball with the user's scalp. Since, the human head is curved, just a few comb teeth usually contact the user's scalp with each pass of the comb through the person's hair. Therefore, it is very likely that the user of the Moses device will not be able to evenly disperse a sufficient amount of liquid over the scalp during routine hair combing. Second, because of the high viscosity of oil-based solutions, the person using the Moses comb has to apply an additional abnormal pressure to the comb to be able to move the roller-balls inside of the nozzles while combing.

None of these prior art hair combs and brushes is designed to efficiently and evenly disperse water-based solutions and other thin and non-viscous liquids over the user's scalp. Accordingly, there is a need for a liquid reservoir hair device that will allow the user to conveniently and evenly disperse water-based and other thin and non-viscous liquids over the scalp during routine hair combing or brushing.

BRIEF SUMMARY OF THE INVENTION

It is the first object of the invention to provide a treatment hairbrush that is capable of dispersing water-based solutions and other thin and non-viscous liquids over the user's scalp during routine hair brushing. At least one absorbent filler unit is placed into a chamber of the hairbrush body and covered by a flexible base. The hairbrush bristles are formed from thin metallic tubes with bores inside, and the plurality of the bristles extend outwardly from the flexible base. At least one absorbent feed rod is placed into each bore of the bristle's tube, and a roller-ball is mounted at a distal end of each bristle's tube to form a roller-ball nozzle. The absorbent feed rods interconnect the absorbent filler unit and the roller-balls, and liquid from the absorbent filler unit passes through the absorbent feed rods to feed a surface of the roller-balls. The liquid disperses over the user's scalp only during rolling contact of the roller-balls with the scalp. The hairbrush can be provided with a removable bristle lid to keep the hairbrush bristles enclosed when the hairbrush is not in use, and to prevent the roller-balls from drying out.

It is another object of the invention to provide the hairbrush with an optional removable handle and with a filler inlet located at a junction between the hairbrush body and the handle. When the hairbrush handle is removed (unscrewed), the user can refill the hairbrush (fill the absorbent filler unit with liquid) with or without a disposable liquid refilling cartridge. The disposable liquid refilling cartridge comes pre-filled with liquid, e.g. a water-based medicated solution. The disposable liquid refilling cartridge and the hairbrush handle are preferably made from a clear plastic, so the user can see and control the amount of the liquid left in the cartridge.

It is a further object of the invention to provide the hairbrush with the chamber, which is only partially filled with the absorbent filler unit. The hairbrush chamber has a liquid reservoir that is connected with the absorbent filler unit. The liquid not yet absorbed by the absorbent filler unit remains free (unabsorbed) in the liquid reservoir and can contact the absorbent filler unit. The hairbrush body can have optional breathing outlets that communicate with the absorbent filler unit and enable the liquid reservoir and the absorbent filler unit to "breathe" in response to consumption of the liquid and/or to changes in temperature and pressure. When the bristle lid is closed, it covers and seals the breathing outlets.

BRIEF DESCRIPTION OF THE DRAWINGS

The invention is set forth in greater detail, with reference to the drawings, but is not so limited.

DETAILED DESCRIPTION OF THE INVENTION

Figure 1:
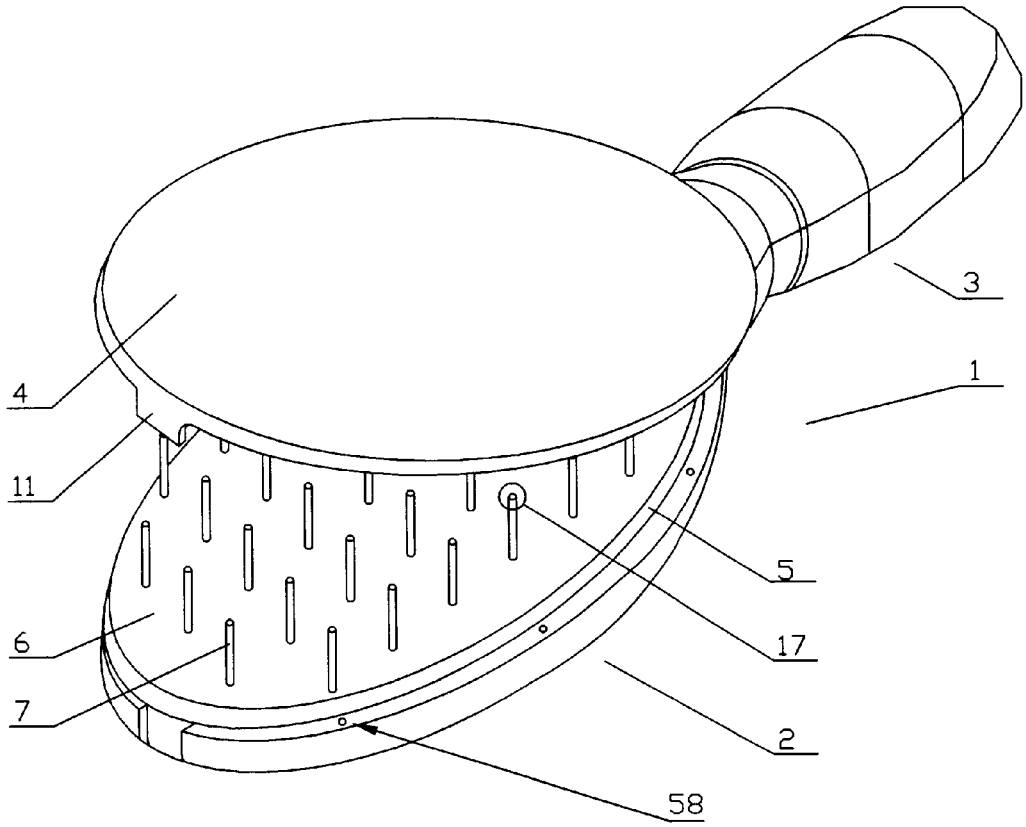
FIG. 1 is a perspective view of the hairbrush in accordance with the invention. A bristle lid is partially open and a bristle area is shown.

The major goal of the present invention is to provide a liquid-reservoir hairbrush that will allow the user to conveniently and evenly disperse water-based solutions and other thin and non-viscous liquids over the scalp during routine hair brushing without getting the user's hair damp. To accomplish this objective, the following main features will be combined in the hairbrush of the present invention:

(a) The hairbrush will have a chamber (viz., liquid reservoir) at least partially filled with at least one absorbent filler unit;

(b) Thin metallic tubes with bores inside will be used to form the hairbrush bristles;

(c) Liquid outlets (viz., nozzles) will be formed at distal ends of the hairbrush bristles by mounting a roller-ball at the distal end of each bristle's tube;

(d) The absorbent feed rods will be placed into the bristle's bores and used for the following:

to transport liquid from the absorbent filler unit down to the roller-ball nozzles located at the distal ends of the hairbrush bristles, and to prevent a natural outflow of liquid through the roller-ball nozzles;

(e) The hairbrush will be provided with an optional removable handle and a filler inlet located inside a junction between the hairbrush body and the handle. Thus, the user will be able to refill the hairbrush (fill the absorbent filler unit with liquid) with or without a disposable liquid refilling cartridge; and (f) The disposable liquid refilling cartridge will also increase the amount of liquid that can be held in the hairbrush (the cartridge can be attached to the hairbrush even when the absorbent filler unit is completely filled with liquid), and lets the user know when the hairbrush has to be refilled with liquid (allows the user to see and control the amount of liquid left in the cartridge, and, accordingly, the amount of liquid left in the absorbent filler unit).

Referring to FIGS. 1–5, the hairbrush 1 of the present invention has a body 2, a handle 3, an optional bristle lid 4 and a bristle frame 5 with a flexible base 6 and a plurality of bristles 7. The body 2 has a chamber 8 (FIG. 4) and a hairbrush frame 9. An absorbent filler unit 10 is placed into the chamber 8 and covered by the bristle frame 5. The bristle lid 4 has a catch clip 11 and two holders 12, which engage with the body 2 near the handle 3 to permit detachable engagement of the bristle lid 4 with the body 2 of the hairbrush 1. The body 2, the handle 3, the bristle lid 4, and the bristle frame 5 are preferably made from plastic; and the flexible base 6 is preferably made from a flexible material, such as rubber or plastic. The flexible base 6 is preferably hermetically attached to the bristle frame 5 (e.g. by adhesives, welding, etc), and the bristle frame 5 is preferably hermetically attached (e.g. by adhesives, welding, etc) to the hairbrush frame 9. The plurality of the bristles 7 extend outwardly from the flexible base 6 held in the bristle frame 5.

Figure 8:
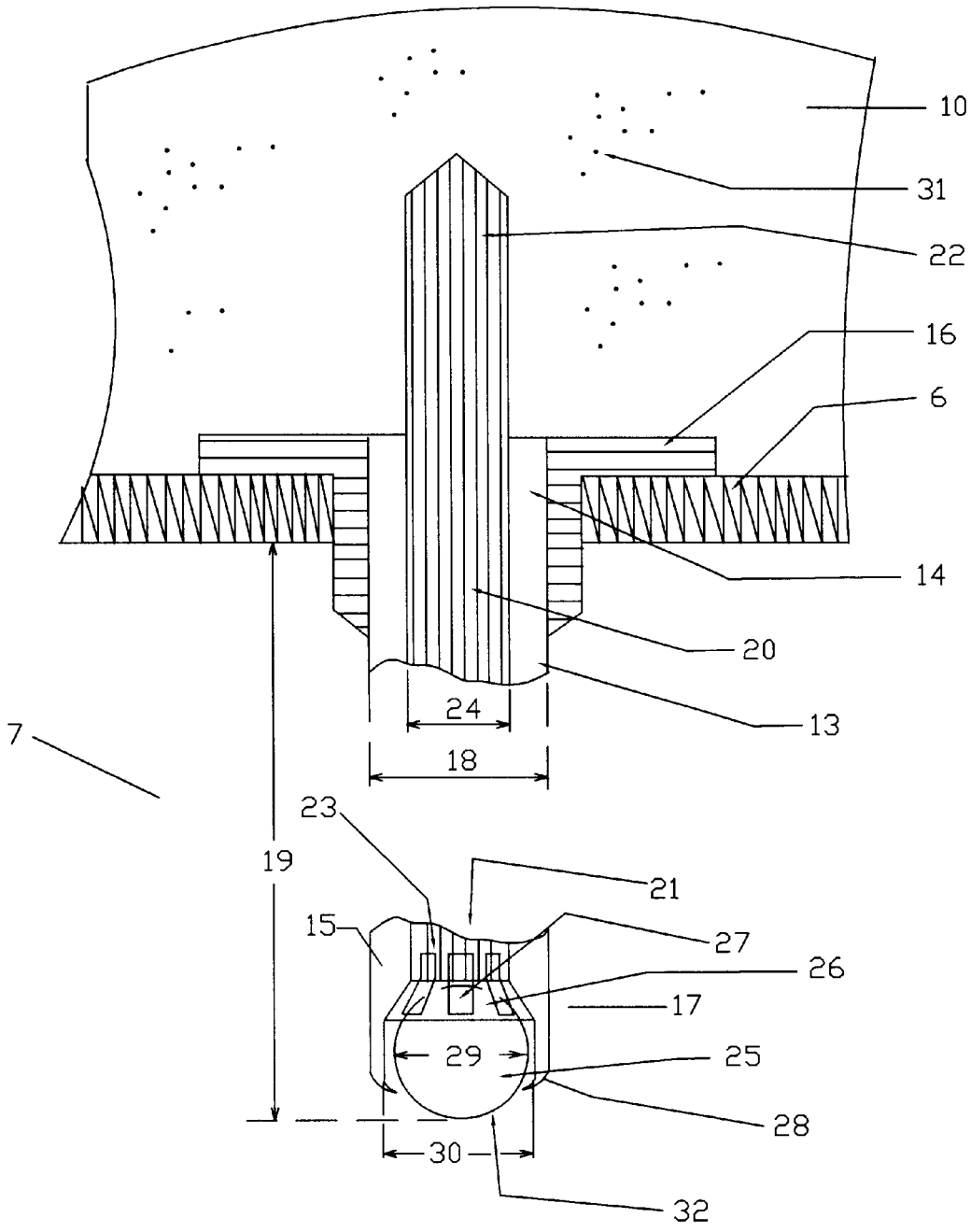
FIG. 8 is a cross-sectional view of the hairbrush bristle in accordance with the invention.

Each bristle 7 (FIG. 8) is preferably formed from a thin metallic tube, however other known materials can be used as well, and consists of a bristle tube 13 with a proximal end 14 and a distal end 15, a bristle tube holder 16 and a roller-ball nozzle 17 (FIGS. 1-4; 6; 7 and 8). The proximal end 14 of each bristle tube 13 is preferably hermetically attached (e.g. by adhesives, welding, etc) to the bristle tube holder 16, which is preferably made from plastic. Each bristle 7 is preferably hermetically attached (e.g. by adhesives, welding, etc) to the flexible base 6 by inserting the bristle tube holder 16 into the flexible base 6. An external diameter 18 of each bristle tube 13 is preferably between 1.5 mm and 2.8 mm, and a length 19 of each bristle 7 is preferably between 1.5 cm and 3 cm, however other sizes can be provided as well.

An absorbent feed rod 20 (FIG. 8) is placed into a bore 21 of the bristle tube 13. A proximal end 22 of the absorbent feed rod 20 extends into the hairbrush body 2 (FIGS. 4; 5 and 8) and into the absorbent filler unit 10, and contacts the absorbent filler unit 10. The absorbent filler unit 10 can be formed from a mass or bundles of fibers, porous polyester or nylon, or other known porous materials with a preferable porosity between 60% and 80%. The size of the absorbent filler unit 10 may preferably be between 80 $cm^3$ and 120 $cm^3$, so the total amount of liquid, which can be retained by the absorbent filler unit 10, can be approximately between 48 ml and 96 ml. The absorbent feed rod 20 can be formed from a bundle of resin-bonded fibers, however other known materials can be used as well. A diameter 24 of the absorbent feed rod 20 may preferably be between 1 mm and 2.5 mm.

The roller-ball nozzle 17 (FIG. 8) is located at the distal end 15 of the bristle tube 13 and comprises a roller-ball 25 and a roller-ball seat 26. The roller-ball seat 26 is formed at the distal end 15 of the bristle tube 13 and has open capillary channels 27 and a rim structure 28. The open capillary channels 27 extend into the bore 21 and contact the distal end 23 of the absorbent feed rod 20.

The roller-ball 25 (FIG. 8) partially extends outwardly beyond the roller-ball seat 26 in order to contact the user's scalp during brushing. The roller-ball 25 can be made from stainless steel, ceramic, or other known materials. A diameter 29 of the roller-ball 25 is preferably between 1.5 mm-2.5 mm, however other sizes can be provided as well. An internal diameter 30 of the roller-ball seat 25 is preferably 0.075 mm-0.15 mm larger than the diameter 29 of the roller-ball 25, however other size difference can be provided as well.

The absorbent feed rod 20 (FIG. 8) interconnects the absorbent filler unit 10 and the roller-ball 25. Liquid 31 from the absorbent filler unit 10 is supplied to the roller-ball 25, by means of the liquid 31 passing through the absorbent feed rod 20 and the open capillary channels 27 to feed a surface 32 of the roller-ball 25. The roller-ball 25 is mounted within the roller-ball seat 26 for rotation movement to transfer the liquid 31 from the distal end 23 of the absorbent feed rod 20 to the user's scalp upon rotation contact of the roller-ball 25 with the user's scalp.

Figure 6:
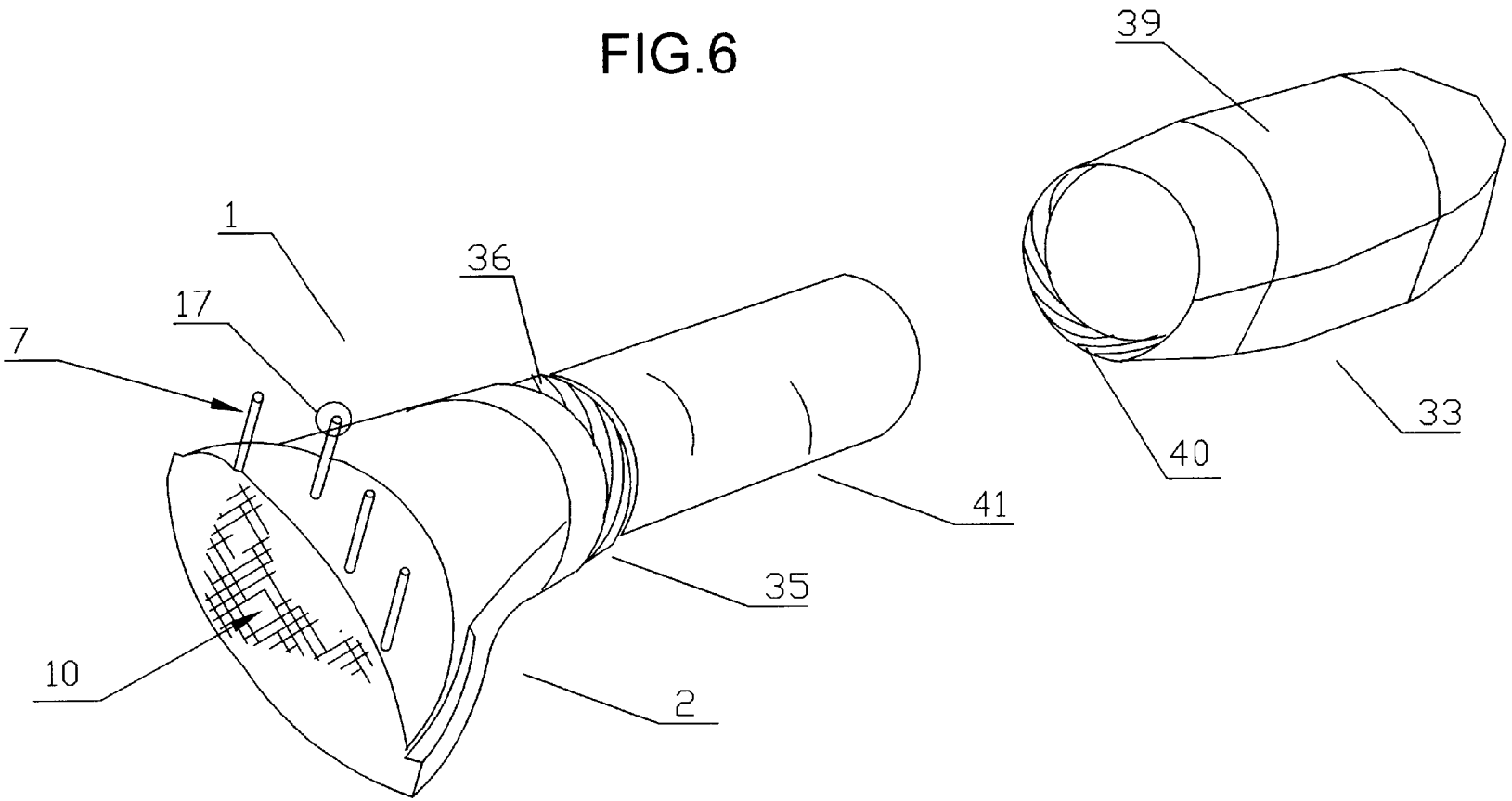
FIG. 6 is a partial exploded perspective view of the hairbrush in accordance with the invention showing an optional removable hairbrush handle and a disposable liquid refilling cartridge. The hairbrush handle is unscrewed and the disposable liquid refilling cartridge is attached to the hairbrush body.
Figures 7, 7A, 7B:
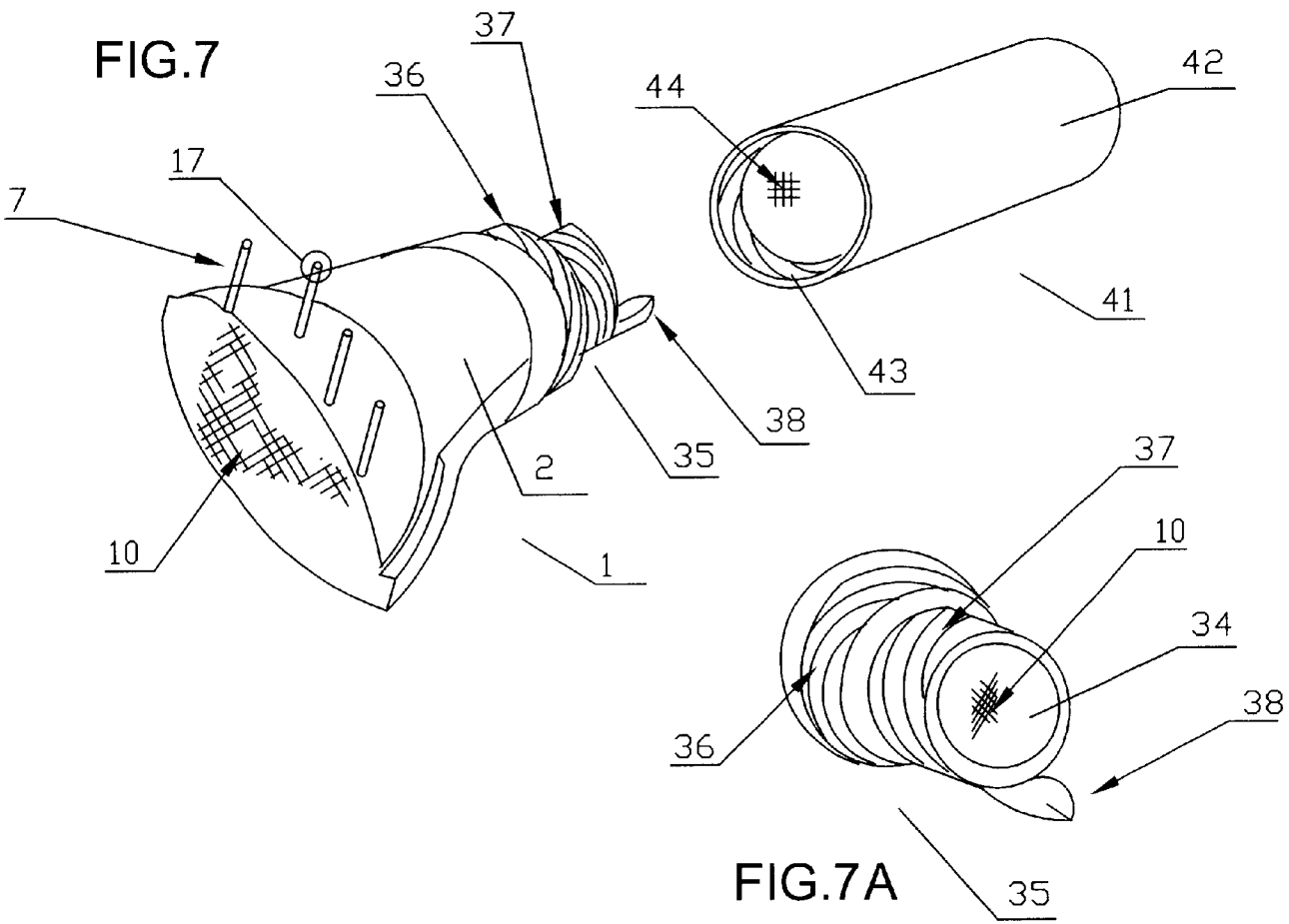
FIG. 7 is a partial exploded perspective view of the hairbrush of FIG. 6 showing a junction for the removable hairbrush handle and for the disposable liquid refilling cartridge. The removable hairbrush handle is unscrewed and not shown.
FIG. 7A is an exploded perspective view of the junction of the hairbrush of FIG. 7 showing a filler inlet.
FIG. 7B is a perspective view of the disposable liquid refilling cartridge.

The hairbrush 1 (FIGS. 1-7) can come pre-filled with liquid (e.g. a water-based medicated solution) and can be provided with an optional removable handle 33 (FIG. 6) and a filler inlet 34 (FIG. 7A). The filler inlet 34 is located inside a junction 35 (FIGS. 6; 7 and 7A) between the hairbrush body 2 and the removable handle 33. The junction 35 has a handle thread 36, a filling thread 37, an opener 38 and the filling inlet 34. The removable handle 33 has a handle body 39 and a thread 40. The junction 35 is preferably hermetically attached (e.g. by adhesives, welding, etc) to the hairbrush body 2. The removable handle 33 is removably attached to the hairbrush body 2 at the junction 35—screwed onto the handle thread 36.

When the removable handle 33 (FIG. 6) is unscrewed and the filler inlet 34 (FIG. 7A) is open, the user can refill (fill with liquid) the absorbent filler unit 10 with or without a disposable liquid refilling cartridge 41 (FIGS. 6 and 7B). The disposable liquid refilling cartridge 41 comes pre-filled with liquid (e.g. a water-based medicated solution) and has a cartridge body 42, a cartridge lid 44, and a cartridge thread 43. When the cartridge 41 is attached to the filling thread 37 of the junction 35, the opener 38 pushes the cartridge lid 44 into the cartridge body 42, so the liquid from the cartridge 41 can contact the absorbent filler unit 10, and the absorbent filler unit 10 can absorb the liquid from the cartridge 41.

To refill (fill with liquid) the hairbrush 1 using the disposable liquid refilling cartridge 41, the user has to unscrew the removable handle 33 (FIG. 6) from the junction 35 (FIG. 7) and screw the disposable liquid refilling cartridge 41 (FIG. 7B) onto the filling thread 37. Then, the user has to reattach the removable handle 33 to the junction 35—screw the removable handle 33 onto the handle thread 36. The disposable liquid refilling cartridge 41 can stay inside the removable handle 33 connected to the junction 35 even when the absorbent filler unit 10 absorbs all of the liquid from the disposable liquid refilling cartridge 41.

The disposable liquid refilling cartridge 41 can have different sizes and hold a predetermined volume of liquid depending on the particular design of the hairbrush 1 and the liquid capacity of the absorbent filler unit 10.

The disposable liquid refilling cartridge 41 and the removable handle 33 are preferably made from a clear plastic, so the user can see and control the amount of liquid left in the disposable liquid refilling cartridge 41. The user has to replace the disposable liquid refilling cartridge 41 with the new pre-filled disposable liquid refilling cartridge 41 when the disposable liquid refilling cartridge 41 becomes empty (when the absorbent filler unit 10 absorbs all of the liquid from the disposable liquid refilling cartridge 41). The disposable liquid refilling cartridge 41 has to be disposed of after one use.

The disposable liquid refilling cartridge 41 has the following three main features:

- Allows the user to conveniently refill the hairbrush 1 with liquid;
- Increases the amount of liquid that can be held in the hairbrush 1 (the disposable liquid refilling cartridge 41 can be attached to the hairbrush 1 even when the absorbent filler unit 10 is completely filled with liquid); and
- Allows the user to know when the hairbrush 1 has to be refilled with liquid (allows the user to see and control the amount of liquid left in the disposable liquid refilling cartridge 41, and, accordingly, the amount of liquid left in the absorbent filler unit 10).

Figure 2:
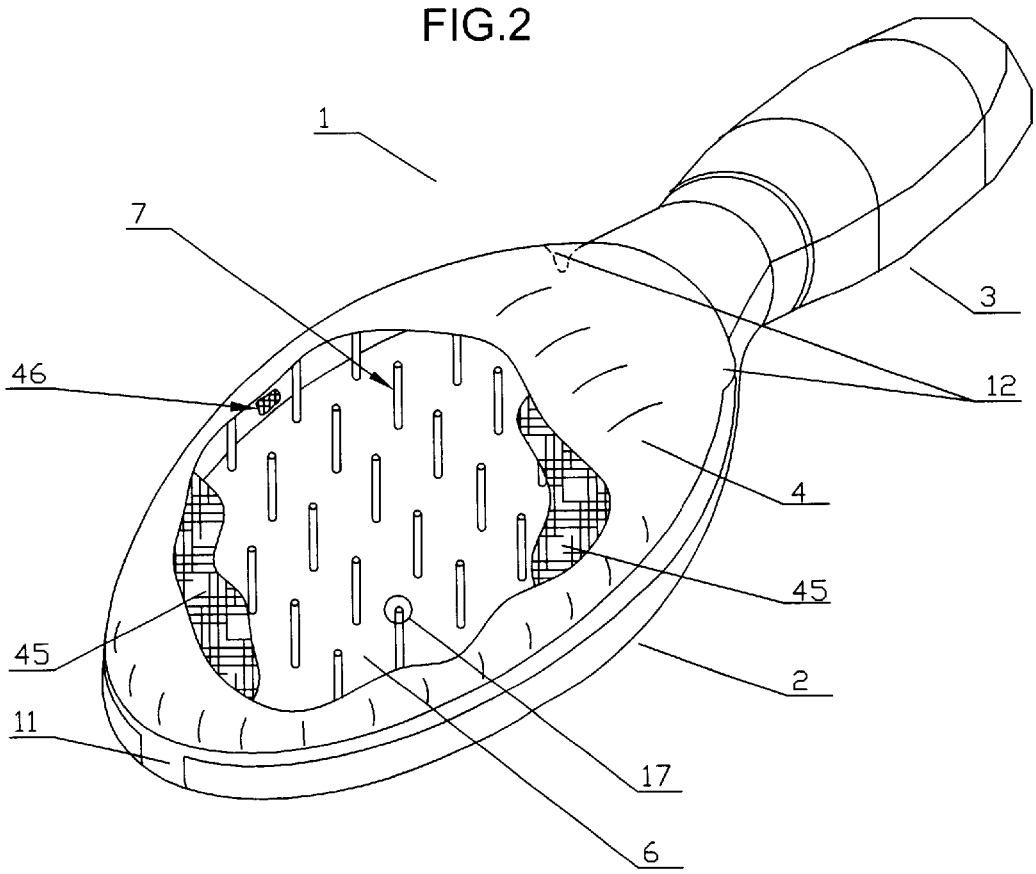
FIG. 2 is a perspective view of the hairbrush of FIG. 1 with the bristle lid closed and partially exposed to show the bristle area and the bristle lid's cleaning pad.
Figure 3:
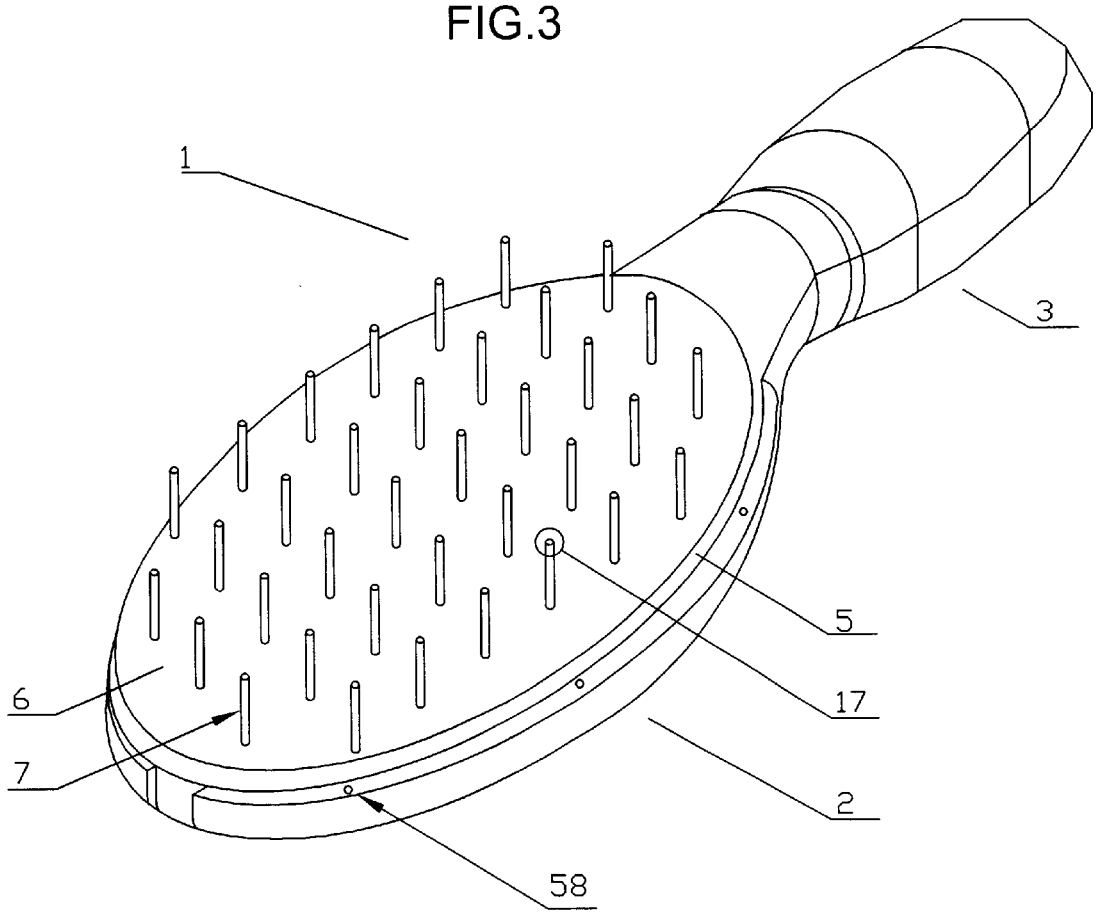
FIG. 3 is a perspective view of the hairbrush of FIG. 1 shown without the bristle lid.
Figure 4:
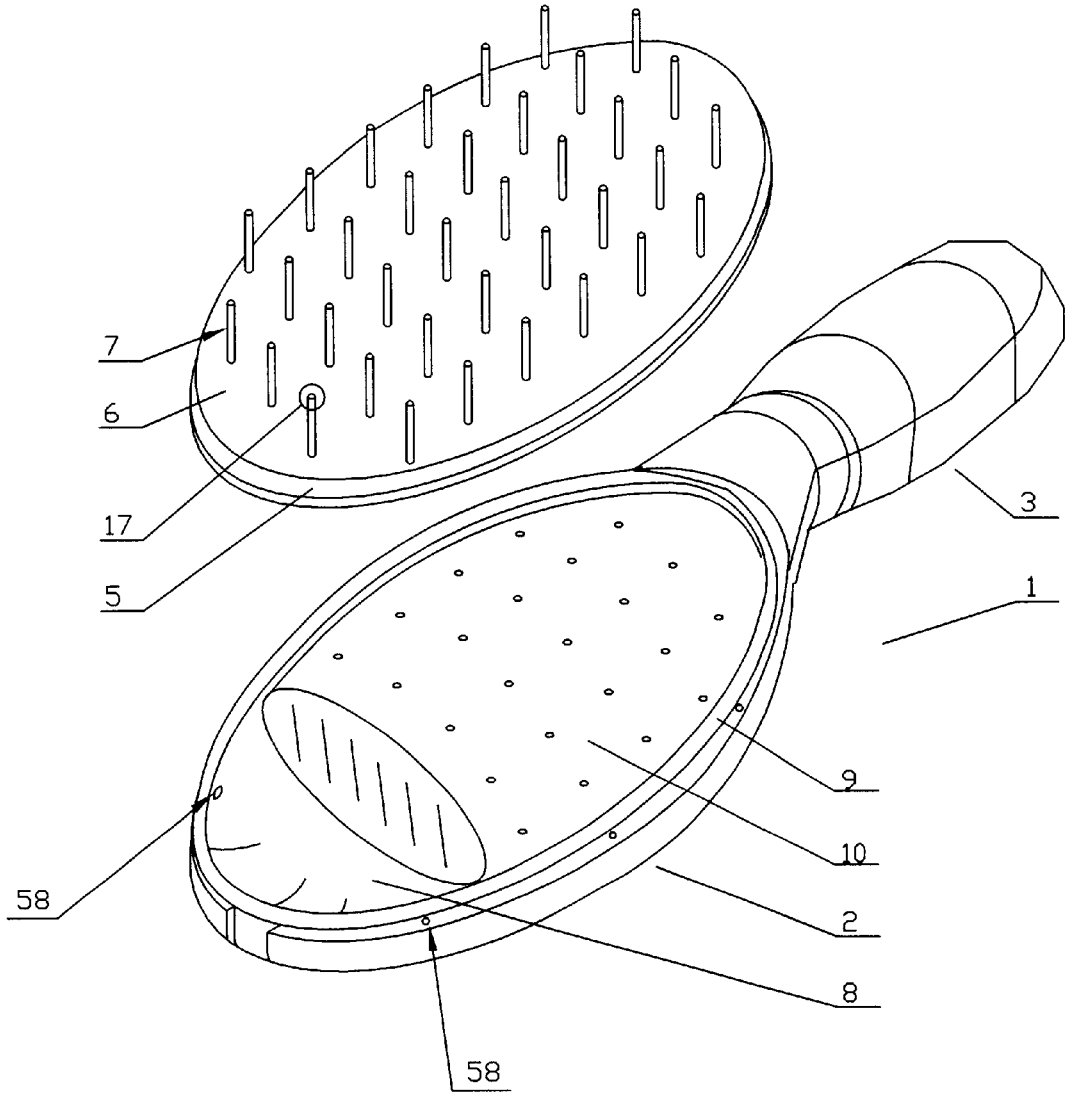
FIG. 4 is an exploded perspective view of the hairbrush of FIG. 1 with a bristle frame removed to show a partially exposed absorbent filler unit.
Figure 5:
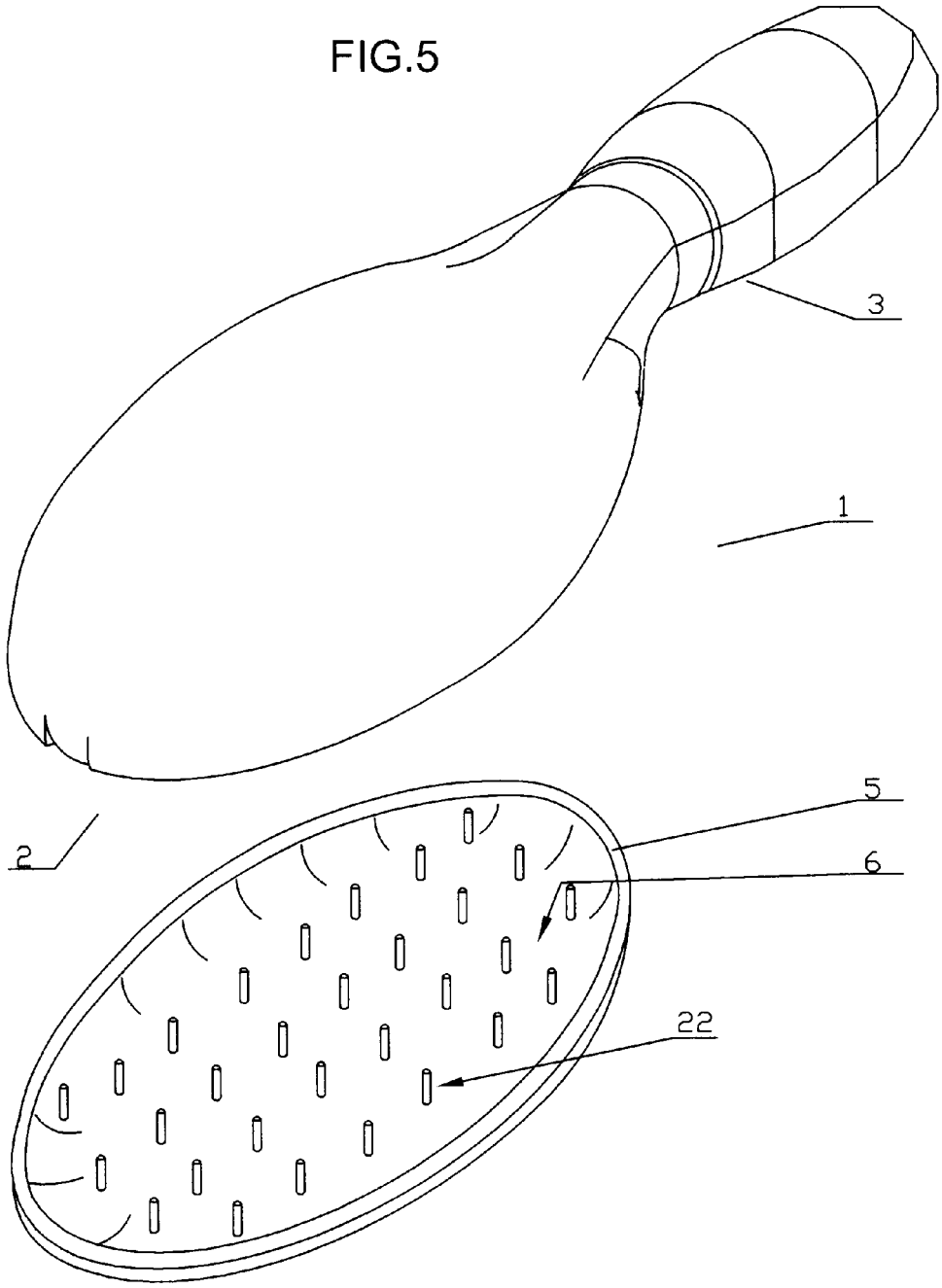
FIG. 5 is an exploded perspective view of the hairbrush of FIG. 1 with the bristle frame removed to show proximal ends of absorbent feed rods of the hairbrush bristles.

The optional bristle lid 4 (FIGS. 1-2) can be provided to keep the hairbrush bristles 7 enclosed when the hairbrush 1 is not in use and helps prevent the roller-balls 25 (FIG. 8) from drying out. The bristle lid 4 can have an optional cleaning pad 45 (FIG. 2). The cleaning pad 45 is attached (e.g. by adhesives, welding, etc) to an inside surface 46 of the bristle lid 4. The cleaning pad 45 is preferably made from a sufficiently spongy plastic material with a textured surface. The cleaning pad 45 covers and contacts the roller-ball nozzles 17 when the bristle lid 4 is closed, and, therefore, cleans the roller-ball nozzles 17 after every brushing when the user closes the bristle lid 4 onto the bristles 7. The bristle lid 4 is conveniently removably mounted to the hairbrush body 2 by the catch clip 11 and two holders 12.

Figure 9:
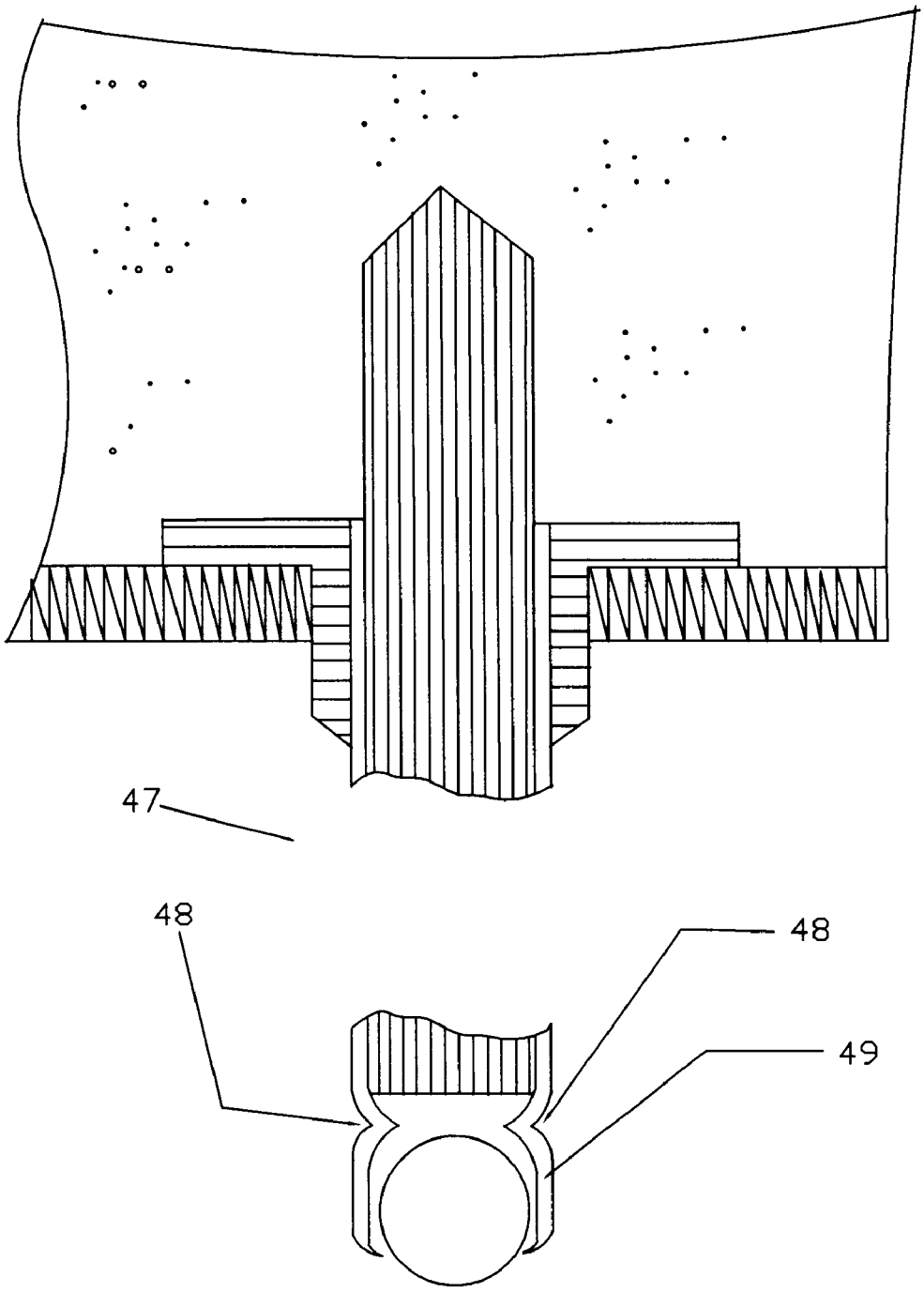
FIG. 9 is a cross-sectional view of an alternative type of the hairbrush bristle in accordance with the invention.

Referring to FIG. 9, the hairbrush 1 (FIGS. 1-7) of the present invention can be provided with an alternative type of bristles 47, wherein the bristle 47 is similar to the bristle 7 (FIG. 8), except that the bristle 47 has a plurality of inward segments 48, which form a roller-ball seat 49.

Figure 10:
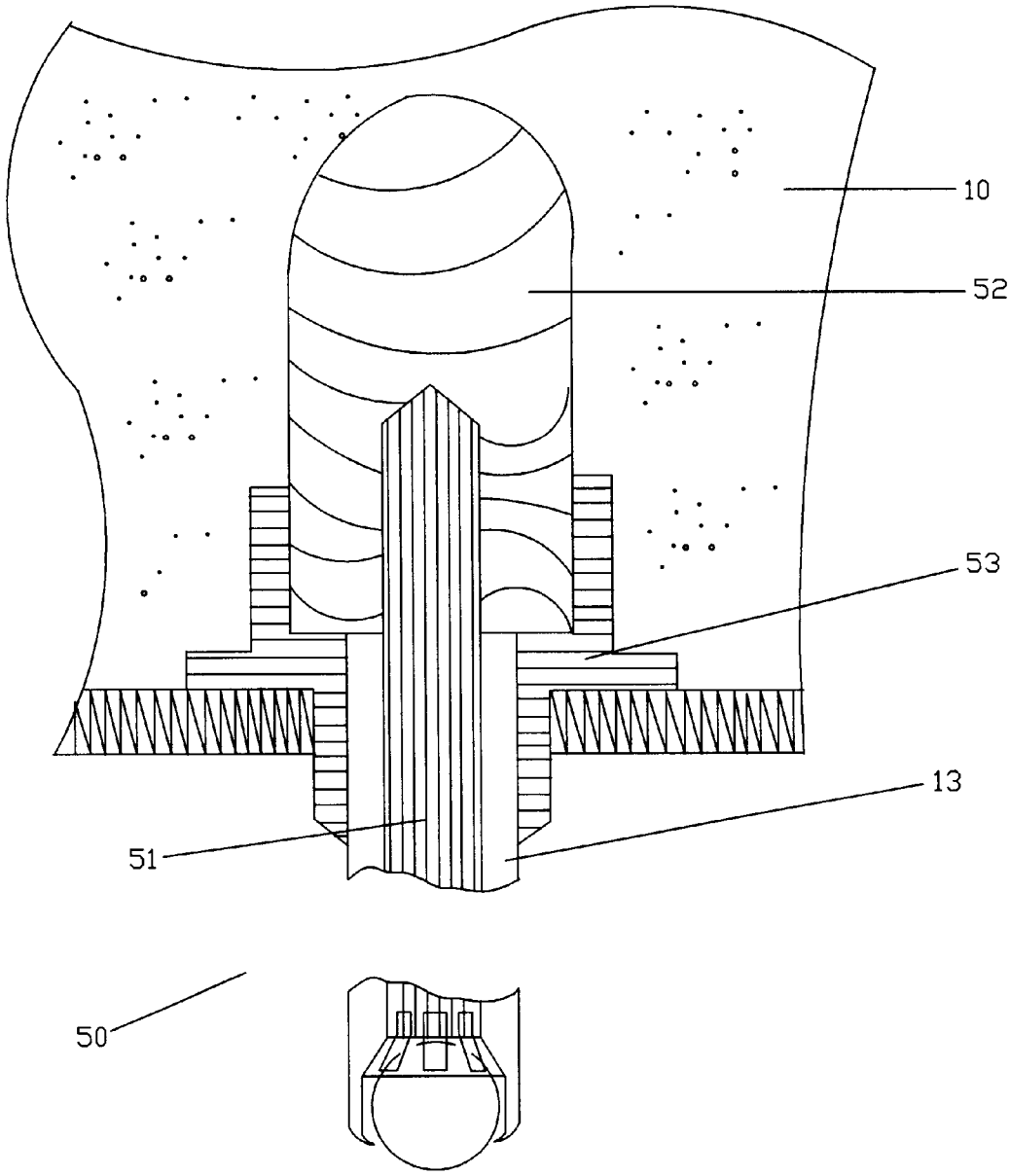
FIG. 10 is a cross-sectional view of another alternative type of the hairbrush bristle in accordance with the invention.

Referring to FIG. 10, the hairbrush 1 (FIGS. 1-7) of the present invention can also be provided with another alternative type of bristles 50, wherein the bristle 50 is similar to the bristle 7 (FIG. 8), except that the bristle 50 has two absorbent feed rods: a distal absorbent feed rod 51, which is preferably made from plastic, and a proximal absorbent feed rod 52, which is preferably made from fiber. The distal absorbent fed rod 51 extends into the proximal absorbent fed rod 52 and contacts the proximal absorbent feed rod 52. The proximal absorbent fed rod 52 extends into the absorbent filler unit 10 and contacts the absorbent filler unit 10. A bristle tube holder 53 firmly puts together the proximal absorbent fed rod 52, the distal absorbent fed rod 51 and the bristle tube 13.

Figure 11:
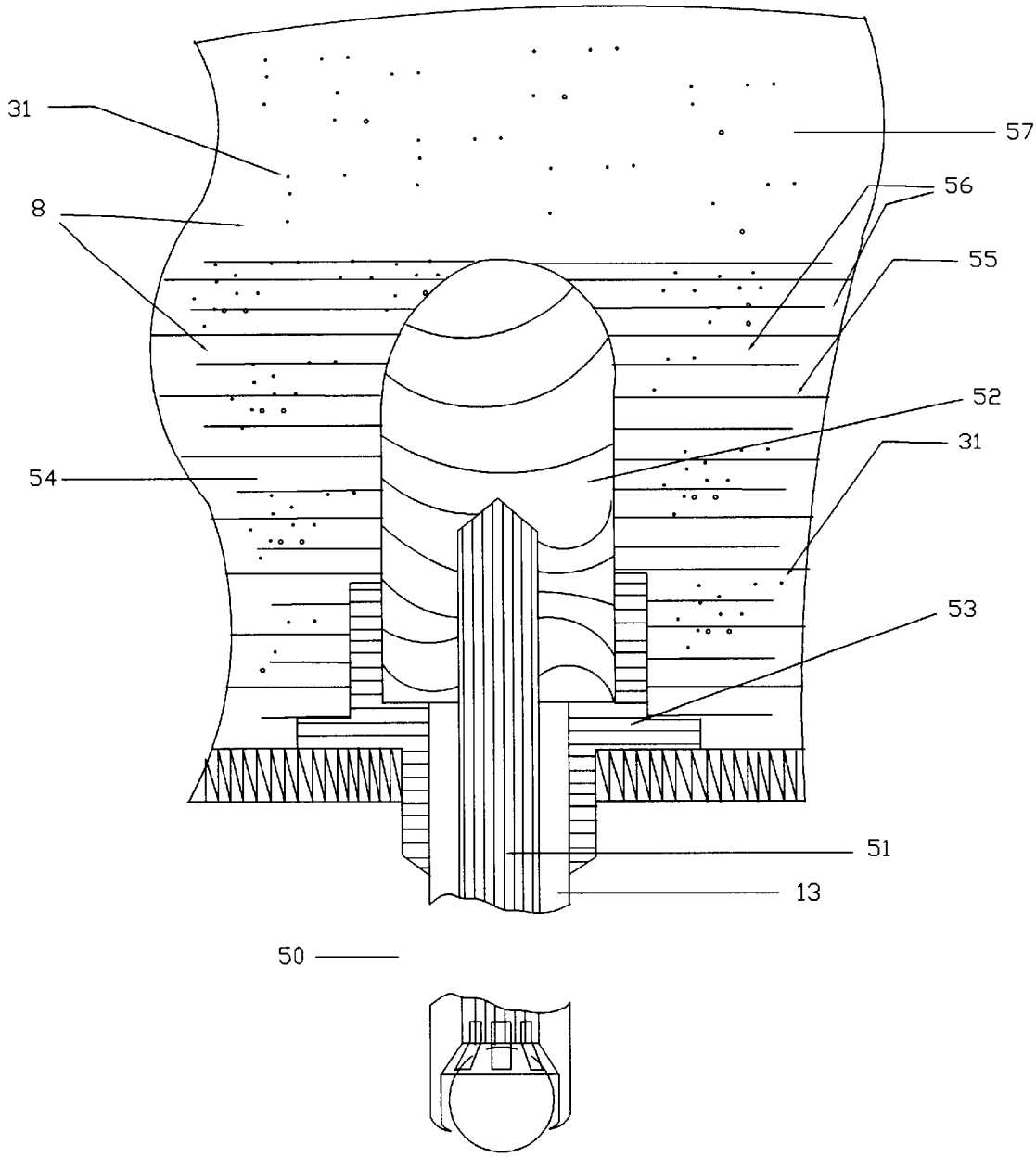
FIG. 11 is a cross-sectional view of the hairbrush bristle of FIG. 10 showing an alternative type of the absorbent filler unit.

Referring to FIG. 11, the hairbrush 1 (FIGS. 1-7) of the present invention can be provided with the bristles 50 (FIG. 10) and an alternative type of absorbent filler unit 54 (FIG. 11). The absorbent filler unit 54 is formed from a plurality of closely spaced plastic membranes 55 with capillary passages 56. The proximal absorbent feed rod 52 extends into the absorbent filler unit 54, contacts and communicates with the plastic membranes 55 and the capillary passages 56. The chamber 8 (FIG. 4) of the hairbrush 1 is only partially filled with the absorbent filler unit 54 (FIG. 11) and has a reservoir 57, which is connected with the absorbent filler unit 54. The liquid 31 not yet absorbed by the absorbent filler unit 54 remains free (unabsorbed) in the reservoir 57 and can contact the absorbent filler unit 54. Referring back to FIGS. 1, 3 and 4 the hairbrush 1 can be provided with optional breathing outlets 58. The breathing outlets 58 communicate with the absorbent filler unit 54 and enable the reservoir 57 and the absorbent filler unit 54 to "breathe" in response to consumption of the liquid 31 and/or to changes in temperature and pressure. When the bristle lid 4 is closed, it covers and seals the breathing outlets 58.

The aforementioned hairbrush of the present invention is relatively inexpensive to produce and provide a convenient and efficient method to evenly disperse low viscosity water-based solutions and other thin and non-viscous liquids over the user's scalp during routine hair brushing.

I claim:

1. A liquid-reservoir hairbrush adapted for dispersing water-based solutions and other thin and non-viscous liquids over a user's scalp during hair brushing, comprising:

(a) a hairbrush body having a chamber;

(b) at least one absorbent filler unit adapted to retain liquid which is placed into the chamber;

(c) a filler inlet to permit the user to refill the absorbent filler unit with liquid; and (d) a plurality of hairbrush bristles, each having a proximal end and a distal end, the hairbrush bristles being mounted in a vicinity of their proximal ends to the hairbrush body, wherein at least some of the hairbrush bristles comprise:

an elongate body with at least one bore formed therethrough, at least one absorbent feed rod placed into the at least one bore, and a nozzle located at the distal end of each hairbrush bristle comprising at least one rotatably mounted roller-ball, wherein the liquid from the at least one absorbent filler unit is supplied through the at least one absorbent feed rod in a direction of the at least one roller-ball, and wherein the liquid will exit the nozzle when the roller-ball makes rolling contact with the user's scalp.

2. The hairbrush of claim 1, wherein the absorbent filler unit is pre-filled with the liquid.

3. The hairbrush of claim 1, further comprising a bristle lid to keep the hairbrush bristles enclosed when the hairbrush is not in use and to help prevent the roller-balls from drying out.

4. The hairbrush of claim 3, wherein the bristle lid has a cleaning pad, and wherein the cleaning pad provides cleaning to the nozzles when the bristle lid is closed on the hairbrush bristles.

5. The hairbrush of claim 1, further comprising a disposable liquid refilling cartridge that is pre-filled with the liquid, and wherein the disposable liquid refilling cartridge is adapted to place the liquid into the absorbent filler unit and to engage with the hairbrush body when the filler inlet is open.

6. A liquid-reservoir hairbrush adapted for dispersing water-based solutions and other thin and non-viscous liquids over a user's scalp during hair brushing, comprising:

(a) a hairbrush body having a chamber, wherein the chamber is only partially filled with the at least one absorbent filler unit, and wherein the chamber further comprising a liquid reservoir, and wherein the liquid reservoir is connected with the at least one absorbent filler unit;

(b) at least one absorbent filler unit adapted to retain liquid which is placed into the chamber; and (c) a plurality of hairbrush bristles, each having a proximal end and a distal end, the hairbrush bristles being mounted in a vicinity of their proximal ends to the hairbrush body, wherein at least some of the hairbrush bristles comprise:

an elongate body with at least one bore formed therethrough, at least one absorbent feed rod placed into the at least one bore, and a nozzle located at the distal end of each hairbrush bristle comprising at least one rotatably mounted roller-ball, wherein the liquid from the at least one absorbent filler unit is supplied through the at least one absorbent feed rod in a direction of the at least one roller-ball, and wherein the liquid will exit the nozzle when the roller-ball makes rolling contact with the user's scalp.

7. The hairbrush of claim 6 further comprising breathing outlets, which communicate with the at least one absorbent filler unit and enable the at least one absorbent filler unit and the liquid reservoir to breathe in response to consumption of liquid or changes of temperature or pressure.

8. The hairbrush of claim 7 further comprising a bristle lid, which can cover and seal the breathing outlets.

* * * * *